US005244152A

United States Patent [19]

Hofmann

[11] Patent Number: 5,244,152

[45] Date of Patent: Sep. 14, 1993

[54] FUEL-INJECTION VALVE FOR INTERNAL-COMBUSTION ENGINES

[75] Inventor: Karl Hofmann, Neckarrems, Fed. Rep. of Germany

[73] Assignee: Robert Bosch GmbH, Stuttgart, Fed. Rep. of Germany

[21] Appl. No.: 910,032

[22] PCT Filed: Jan. 17, 1991

[86] PCT No.: PCT/DE91/00027

§ 371 Date: Jul. 27, 1992

§ 102(e) Date: Jul. 27, 1992

[87] PCT Pub. No.: WO91/14092

PCT Pub. Date: Sep. 19, 1991

[30] Foreign Application Priority Data

Feb. 23, 1990 [DE] Fed. Rep. of Germany ..... 4005774

[51] Int. Cl.[5] ..... F02M 45/08; F02M 61/20

[52] U.S. Cl. ..... 239/533.4; 239/533.9; 403/340

[58] Field of Search ..... 239/533.2-533.5, 239/533.9, 533.12; 123/299, 300; 403/339, 340, 364

[56] References Cited

U.S. PATENT DOCUMENTS

| | | | |
|---|---|---|---|
| 2,470,282 | 5/1949 | Baker et al. | 403/340 |
| 4,527,986 | 7/1985 | Bridgewater et al. | 403/339 |
| 4,768,719 | 9/1988 | Straubel et al. | 239/533.4 |
| 4,852,808 | 8/1989 | Yamamoto | 239/533.3 |
| 4,962,890 | 10/1990 | Shindo et al. | 239/533.9 |
| 5,161,742 | 11/1992 | Hofmann et al. | 239/533.9 |
| 5,165,607 | 11/1992 | Stevens | 239/533.9 |

FOREIGN PATENT DOCUMENTS

| | | |
|---|---|---|
| 2127460 | 1/1973 | Fed. Rep. of Germany . |
| 3839038 | 5/1990 | Fed. Rep. of Germany . |
| 2084553 | 12/1971 | France . |
| 329505 | 6/1958 | Switzerland . |

OTHER PUBLICATIONS

Patent Abstracts of Japan, vol. 9 No. 25 (M-355) (1748), Feb. 2, 1985.

*Primary Examiner*—Andres Kashnikow
*Assistant Examiner*—Karen B. Merritt
*Attorney, Agent, or Firm*—Michael J. Striker

[57] ABSTRACT

A fuel injection nozzle for internal combustion engines has a nozzle body, a valve needle displaceably supported by the nozzle body, and a nozzle holder connected with the nozzle body and containing a spring chamber having a base. In the spring chamber are first and second closing springs arranged one after the other and acting on the valve needle one after the other. A first thrust pin penetrates the second closing spring. The first closing spring, which is farther away from the nozzle body, is supported at the base of the spring chamber and acts on the valve needle via the first thrust pin. The second closing spring is closer to the nozzle body and supported on a housing side and acts on the valve needle via discs and an intermediate bush. A second thrust pin penetrates the first closing spring and is arranged coaxially to the first thrust pin. The second closing spring is supported at the base of the spring chamber via the second thrust pin. The thrust pins have ends which face each other and carry heads with fingers which engage through one another and on which the closing springs are supported.

6 Claims, 1 Drawing Sheet

FUEL-INJECTION VALVE FOR INTERNAL-COMBUSTION ENGINES

BACKGROUND OF THE INVENTION

The present invention relates to a fuel injection valve for internal combustion engines.

More particularly, it relates to a fuel injection nozzle with a nozzle body which supports a valve needle and with a nozzle holder connected with the nozzle body and containing a spring chamber for receiving two closing springs acting on the valve needle one after the other.

Such fuel injection valves are known in the art.

In an injection nozzle of this generic type (DE-OS 36 10 658), the spring chamber in the nozzle holder receives the two closing springs which are arranged one after the other in the axial direction. The closing spring lying closer to the valve needle is supported via a disk at an annular shoulder of the spring chamber so that the chamber is divided into a region with a large diameter and a region with a small diameter. As a result, the small diameter is no longer sufficient for receiving a suitable spring in a conventional standard outer diameter of the nozzle holder of e.g. 17 mm.

To prevent an increase in the outer diameter in injection nozzles of the generic type compared to commercially available constructions it is suggested in the German Patent Application P 38 39 038 to construct the spring chamber serving to receive the two closing springs in the nozzle holder with the same diameter along the entire length and to support the closing spring adjacent to the valve needle at a cross-pin penetrating the spring chamber. In this construction the two closing springs can have the same diameter but the transverse bore hole for the cross-pin in the housing of the nozzle holder impairs its strength and tightness.

SUMMARY OF THE INVENTION

Accordingly, it is an object of the present invention to provide a fuel injection valve which avoids the disadvantages of the prior art.

In keeping with these objects and with others which will become apparent hereinafter, one feature of the present invention resides, briefly stated, in a fuel injection valve in which the second closing spring is supported at a base of the spring chamber via a second thrust pin which penetrates the first closing pin and is arranged coaxially to a first thrust pin which penetrates the second closing spring and the ends of the two thrust pins which face each other carry heads with fingers which engage through one another and on which the closing springs are supported.

When the fuel injection valve is designed in accordance with the present invention, it has the advantage over the prior art that the housing of the two-spring nozzle holder can be constructed with the conventional standard outer diameter of e.g. 17 mm. Further, the spring chamber has a constant diameter along its entire length which can be kept relatively small. Moreover the mounting of the closing springs and thrust pins is very simple.

In accordance with another feature of the present invention a simple and automated fabrication of the claw-like fingers is made possible when the latter have an annular segment-shaped cross section which is identical in the fingers of both heads. The adjustment of the opening pressure of the injection nozzle is particularly simple when the thrust pin in the vicinity of the valve needle is constructed in two parts as a smooth pin with a separate head part.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
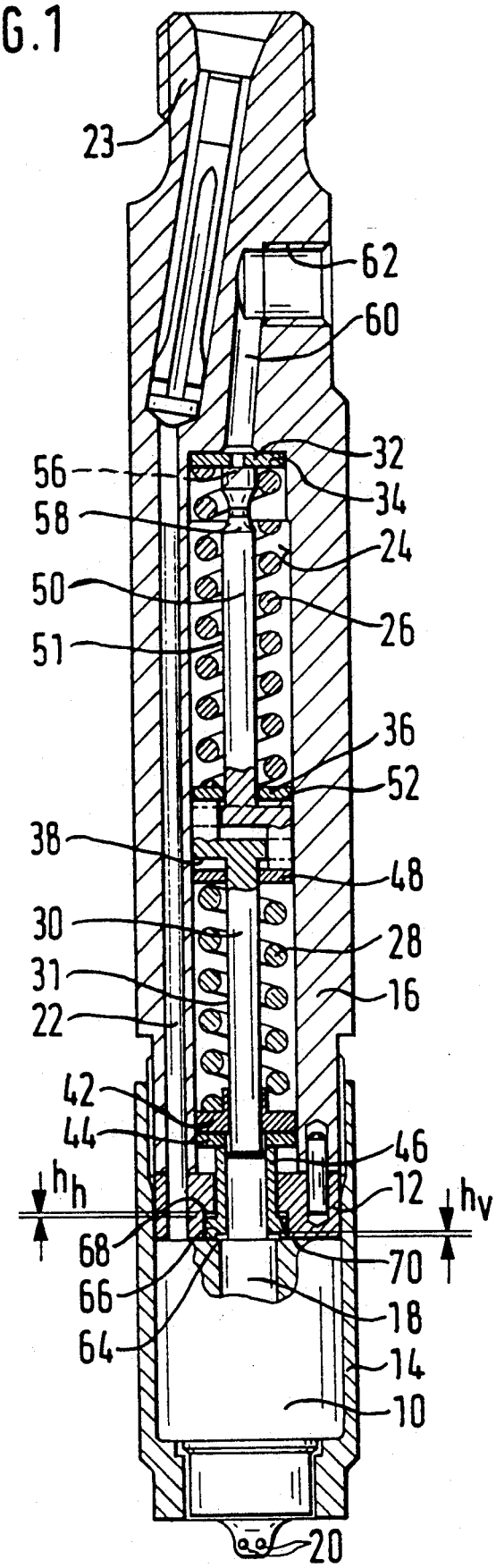
FIG. 1 shows an injection nozzle for a diesel engine in longitudinal section.
Figure 2:
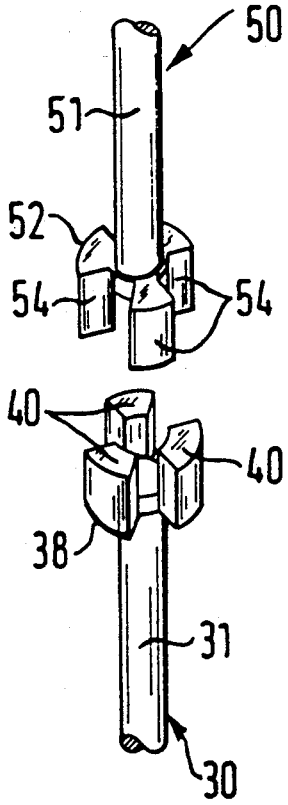
FIG. 2 shows two thrust pins of the injection nozzle according to FIG. 1 in an exploded view and FIG. 3 shows a thrust pin in accordance with another embodiment.

The injection nozzle has a nozzle body 10 which is clamped at a supporting body 16 together with a washer 12 by a union nut 14. A valve needle 18 is displaceably supported in the nozzle body 10 and cooperates with an inwardly directed valve seat in the nozzle body 10 which has a plurality of injection openings 20. The guide bore hole of the valve needle is widened at one place in a conventional manner to form a pressure chamber. In the region of the pressure chamber the valve needle 18 has a pressure shoulder and the pressure chamber is connected with a connection piece 23 at the supporting body 16 via a duct 22 for connecting a fuel delivery line. The fuel acting at the pressure shoulder of the valve needle 18 pushes the valve needle 18 up against the graduated force curve of a closing spring arrangement, described in the following, so that the fuel is sprayed out through the injection openings 20 in a pre-injection phase and a main injection phase.

A spring chamber 24 is arranged in the supporting body 16 coaxially relative to the valve needle 18 which is constructed as an axial pocket bore hole and is sealed at its opening by the washer 12. A first closing spring 26 and a second closing spring 28 which are constructed as helical pressure springs are arranged in a row one after the other in the spring chamber 24. The first closing spring 26 which is further away from the nozzle body 10 acts continuously on the valve needle 18 in its closing direction via a first thrust pin 30. For this purpose the first closing spring 26 is supported via a disk 32 at the base 34 of the spring chamber 24 and via another disk 36 at the upper end of the first thrust pin 30 which is provided with a head. The first thrust pin 30 contacts the upper front side of the valve needle 18 with its lower end.

The second closing spring 28 which is constructed identically to the first closing spring 26 is arranged in the spring chamber 24 adjacent to the nozzle body 10 and encloses the rod-like part 31 of the first thrust pin 30. The second closing spring 28 is supported by its lower front end, via a spring disk 42 and a disk 44, on an intermediate bush 46 which encloses the upper end portion of the valve needle 18 and accordingly contacts the front side of the nozzle body 10 in the closing position of the valve needle 18. With its other end it presses, via a disk 48, on the lower end of a second thrust pin 50 constructed as a head 52. The rod-shaped portion 51 of the thrust pin 50 penetrates the first closing spring 26 and its upper end is supported at the upper disk 32 contacting the base of the spring chamber 24.

The heads 38 and 52 of the two thrust pins 30 and 50 arranged in the spring chamber 24 along the same axis are displaceable in the spring chamber 24 with play and are constructed in such a way that they engage through one another. To this end they have e.g. three claws or fingers 40, 54 which are uniformly distributed on a circle which is coaxial to the axis of the thrust pins 30, 50 and project from the rod-shaped portion 31, 51 of the thrust pins 30, 50 in an axially parallel manner. Their radial cross section has the shape of a circular segment. In the same way, the intermediate spaces between the individual fingers 40, 54 of every head 38, 52 have the shape of a circular segment with a surface which is approximately equal to that of the fingers 40, 54. The fingers 40 of one thrust pin 30 are displaceable with play in the intermediate space between the fingers 52 of the other thrust pin 50 and the fingers 40 of the first thrust pin 30 form a cylindrical ring together with the fingers 54 of the second thrust pin 50. The closing springs 26, 28 are supported via the disks 36, 48 at the front ends of the fingers 40, 54 projecting over the fingers 40, 54 of the other head 38, 52. In the rest position of the nozzle needle 18 and the closing springs 26, 28, the center regions of the two thrust pins 30, 50 are at a distance from one another which is great enough that contact is ruled out when the nozzle needle 18 is completely open.

The spring chamber 24 is connected via a duct 60 with a bore hole 62 for a connection nipple for a leakage oil line for returning leakage oil. A diagonal bore hole 56 in the free end part of the rod-shaped part 51 of the second thrust pin 50 forms the passage for leakage oil from the spring chamber 24 to the axially opening duct 60. One end of the second thrust pin 50 opens coaxially with the hole of the disk 32 contacting the base of the spring chamber 24 and its other end opens into a bottleneck 58 in the end portion of the rod-shaped part 51.

During the injection process, the valve needle 18 executes a pre-stroke $h_v$ in which only the first closing spring 26 acts as a counterforce. During this pre-stroke $h_v$, a defined pre-injection amount is sprayed out of the injection openings 20. The pre-stroke $h_v$ is terminated when a stop 64 comes to rest at the valve needle 18 at the counter-stop 66 of the intermediate bush 46. The valve needle 18 remains in this position until the fuel pressure which continues to increase also overcomes the counter-forces of the two closing springs 26, 28. The valve needle 18, including the intermediate bush 46, is then moved further in the opening direction until it has covered its total lift after a residual lift $h_h$. This total lift is defined by the counter-stop 68 at the washer 12 against which the stop 70 of the intermediate bush 46 abuts. Due to the construction of the two closing springs 26, 28 with the same outer diameter, and the support of the second closing spring 28 at the base 34 via a thrust pin 50 which penetrates the first closing spring 26, the diameter of the spring chamber 24 can be kept very small and the injection nozzle is accordingly made relatively slender as a whole. Moreover, full use is made of the space of the spring chamber 24 by the rod-shaped part 31, 51 of the two thrust pins 30, 50.

Figure 3:
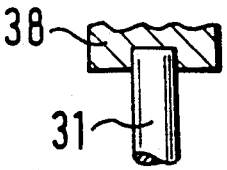

The invention is not limited to the described and shown embodiment example. Alternatively, one or both thrust pins 30, 50 can also have a two-part construction. The head 38, 52 can be separate from the rod-shaped part 31, 51 as shown in FIG. 3 and the rod-shaped part is supported in a central depression at the head. In particular, the mounting of the closing springs 26, 28 and thrust pins 30, 50 is very simple if the thrust pin 30 lying closer to the nozzle body 10 has a two-part construction. In further variations in the design of the thrust pins it is substantial that the heads of the thrust pins engage through one another so that there is a divided action of the closing springs.

It will be understood that each of the elements described above, or two or more together, may also find a useful application in other types of constructions differing from the types described above.

While the invention has been illustrated and described as embodied in a fuel-injection valve for internal-combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injection nozzle for internal combustion engines, comprising a nozzle body; a valve needle displaceably supported by said nozzle body; a nozzle holder connected with said nozzle body and containing a spring chamber having a base; two closing springs arranged one after the other and acting on said valve needle one after the other; a first thrust pin; said closed springs having a first closing spring which is farther away from said nozzle body, is supported at said base of said spring chamber and acts on said valve needle via said first thrust pin, said closing springs also including a second closing spring which is closer to said nozzle body and supported on a housing side and acting on said valve needle, said first thrust pin penetrating said second closing spring; a second thrust pin which penetrates the first closing spring and is arranged coaxially to said first thrust pin, said second closing spring being supported at said base of said spring chamber via said second thrust pin, said thrust pins having ends which face each other and carry heads with fingers which engage through one another and on which said closing springs are supported.

2. A fuel injection nozzle as defined in claim 1, wherein said closing springs are formed as helical closing springs.

3. A fuel injection nozzle as defined in claim 1, wherein said heads of said thrust pins are identical.

4. A fuel injection nozzle as defined in claim 1, wherein said fingers of said heads of said thrust pins have a circular segment-shaped cross-section, said fingers of said first thrust pin complementing the fingers of said second thrust pin to form a cylinder ring.

5. A fuel injection nozzle as defined in claim 1, and further comprising two discs each arranged so that each of said closing springs is supported on said fingers via a respective one of said discs.

6. A fuel injection nozzle as defined in claim 1, wherein said thrust pins have rod-shaped parts, said heads with said fingers of said thrust pins being formed as parts which are separate from said rod-shaped parts.

* * * * *